US009767743B2

(12) United States Patent
Sakai

(10) Patent No.: US 9,767,743 B2
(45) Date of Patent: Sep. 19, 2017

(54) LIQUID CRYSTAL DISPLAY APPARATUS AND METHOD PROVIDING BACKLIGHT CONTROL FOR SUB-FRAMES WITH IDENTICAL IMAGE CONTENTS

(75) Inventor: Shiun Sakai, Aichi (JP)

(73) Assignee: Saturn Licensing LLC, New York, NY (US)

( * ) Notice: Subject to any disclaimer, the term of this patent is extended or adjusted under 35 U.S.C. 154(b) by 997 days.

(21) Appl. No.: 12/466,408

(22) Filed: May 15, 2009

(65) Prior Publication Data

US 2009/0284460 A1 Nov. 19, 2009

(30) Foreign Application Priority Data

May 16, 2008 (JP) ..... P2008-129458

(51) Int. Cl.

*G09G 3/36* (2006.01)
*G09G 3/34* (2006.01)
*G09G 3/20* (2006.01)

(52) U.S. Cl.

CPC ..... *G09G 3/3611* (2013.01); *G09G 3/342* (2013.01); *G09G 3/2025* (2013.01); *G09G 2310/024* (2013.01); *G09G 2320/0261* (2013.01); *G09G 2320/0626* (2013.01); *G09G 2340/0435* (2013.01)

(58) Field of Classification Search

CPC ..... G09G 3/342; G09G 3/3611
USPC ..... 345/102, 103
See application file for complete search history.

(56) References Cited

U.S. PATENT DOCUMENTS

| | | | | |
|---|---|---|---|---|
| 6,693,619 | B1 * | 2/2004 | Miura et al. | 345/102 |
| 7,184,018 | B2 * | 2/2007 | Makino et al. | 345/102 |
| 7,728,810 | B2 * | 6/2010 | You et al. | 345/103 |
| 8,400,392 | B2 | 3/2013 | Kimura et al. | |
| 8,451,209 | B2 * | 5/2013 | Sugino et al. | 345/102 |
| 2006/0050043 | A1 * | 3/2006 | Kawagoe | 345/98 |
| 2006/0146005 | A1 * | 7/2006 | Baba et al. | 345/102 |
| 2006/0214904 | A1 * | 9/2006 | Kimura et al. | 345/102 |
| 2007/0080910 | A1 * | 4/2007 | Park et al. | 345/77 |

(Continued)

FOREIGN PATENT DOCUMENTS

| | | |
|---|---|---|
| CN | 101315748 | 12/2008 |
| JP | 07-199149 A | 8/1995 |

(Continued)

*Primary Examiner* — Kwang-Su Yang
(74) *Attorney, Agent, or Firm* — Wolf, Greenfield & Sacks, P.C.

(57) ABSTRACT

A liquid crystal display apparatus includes the following elements. A liquid crystal display panel section includes a liquid crystal display panel. A backlight section, placed on the rear of the liquid crystal display panel away from an image display surface, extends from end to end of the liquid crystal display panel in the horizontal scanning direction and includes a plurality of blocks arranged in the vertical scanning direction. A circuit section performs control in the first one of a plurality of sub-frames having the same contents displayed on the liquid crystal display panel so that a block irradiating a portion, where an image segment is being updated, in the liquid crystal display panel is turned off, and performs control in another sub-frame other than the first sub-frame so that the block irradiating the portion, where the image segment is being updated, in the liquid crystal display panel is turned on.

4 Claims, 6 Drawing Sheets

(56) References Cited

U.S. PATENT DOCUMENTS

| | | | | |
|---|---|---|---|---|
| 2007/0132709 | A1 | 6/2007 | Kawaguchi et al. | |
| 2008/0018588 | A1 | 1/2008 | Yoshihara et al. | |
| 2008/0129680 | A1* | 6/2008 | Kimura et al. | 345/102 |
| 2008/0297461 | A1* | 12/2008 | Hsu et al. | 345/102 |

FOREIGN PATENT DOCUMENTS

| | | | |
|---|---|---|---|
| JP | 2003-131635 | A | 5/2003 |
| JP | 2003-271111 | A | 9/2003 |
| JP | 2007 192913 | | 8/2007 |
| JP | 2007-206651 | A | 8/2007 |
| JP | 2008-033209 | A | 2/2008 |
| JP | 2008-096928 | A | 4/2008 |
| WO | WO 2006/095304 | | 9/2006 |

* cited by examiner

LIQUID CRYSTAL DISPLAY APPARATUS AND METHOD PROVIDING BACKLIGHT CONTROL FOR SUB-FRAMES WITH IDENTICAL IMAGE CONTENTS

BACKGROUND OF THE INVENTION

1. Field of the Invention

The present invention relates to a liquid crystal display apparatus and a method for controlling the liquid crystal display apparatus.

2. Description of the Related Art

Recent liquid crystal display apparatuses have used a backlight blinking method (also called a blinking backlight method) in order to improve moving picture visibility. For example, Japanese Unexamined Patent Application Publication No. 2007-192913 discloses such a liquid crystal display apparatus. Another video image display technique trend is doubling a synchronization frequency. Specifically, although the frequency of a vertical synchronization (hereinafter, abbreviated to "sync") signal for displaying one frame is typically 60 Hz, the frequency thereof is doubled to 120 Hz in a display apparatus using this technique so that a higher-quality image is obtained.

SUMMARY OF THE INVENTION

According to the above-described related-art doubling technique, two sub-frames identical to each other (i.e., having the same contents) are displayed for one period corresponding to one frame. In the use of doubling the sync frequency in combination with the related-art backlight blinking method, however, if a liquid crystal display panel has poor moving picture response time, blurred images or ghost effects are caused. The sufficient improvement effect of moving picture visibility is not obtained.

It is desirable to provide a technique, based on the backlight blinking method, capable of improving the moving picture visibility in displaying a plurality of sub-frames having the same contents.

According to an embodiment of the present invention, a liquid crystal display apparatus includes the following elements. A liquid crystal display panel section includes a liquid crystal display panel. A backlight section, placed on the rear of the liquid crystal display panel away from an image display surface, extends from end to end of the liquid crystal display panel in the horizontal scanning direction and includes a plurality of blocks arranged in the vertical scanning direction. A circuit section performs control in the first one of a plurality of sub-frames having the same contents displayed on the liquid crystal display panel so that a block irradiating a portion, where an image segment is being updated, in the liquid crystal display panel is turned off, and performs control in another sub-frame other than the first sub-frame so that a block irradiating a portion, where an image segment is being updated, in the liquid crystal display panel is turned on.

According to another embodiment of the present invention, there is provided a method for controlling a liquid crystal display apparatus including a liquid crystal display panel, a backlight section, and a circuit section, the backlight section being placed on the rear of the liquid crystal display panel away from an image display surface, the backlight section extending from end to end of the liquid crystal display panel in the horizontal scanning direction, the backlight section including a plurality of blocks arranged in the vertical scanning direction. The method includes the steps of performing control in the first one of a plurality of sub-frames having the same contents displayed on the liquid crystal display panel so that a block irradiating a portion, where an image segment is being updated, in the liquid crystal display panel is turned off, and performing control in another sub-frame other than the first sub-frame so that a block irradiating a portion, where an image segment is being updated, in the liquid crystal display panel is turned on.

According to a technique in accordance with the embodiments, the backlight section is placed on the rear of the liquid crystal display panel away from the image display surface. The backlight section extends from end to end along the length of the liquid crystal display panel in the horizontal scanning direction and is divided into a plurality of blocks arranged in the vertical scanning direction. The circuit section performs control in the first sub-frame of a plurality of sub-frames having the same contents displayed on the liquid crystal display panel so that a block irradiating a portion, where the contents of an image are being updated, in the liquid crystal display panel is turned off. This control allows the first sub-frame not to be visually recognized. In addition, the circuit section performs control in another sub-frame other than the first sub-frame so that a block irradiating a portion, where the contents of the image are being updated, in the liquid crystal display panel is turned on. The control permits another sub-frame other than the first sub-frame to be visually recognized.

According to the embodiments of the present invention, when a plurality of sub-frames having the same contents are displayed, the backlight section is turned off on a block-by-block basis in the first sub-frame in accordance with the backlight blinking method and is turned on a block-by-block basis in another sub-frame in accordance with the backlight blinking method, thus improving moving picture response time.

DESCRIPTION OF THE PREFERRED EMBODIMENTS

Liquid Crystal Display Apparatus

Figure 1:
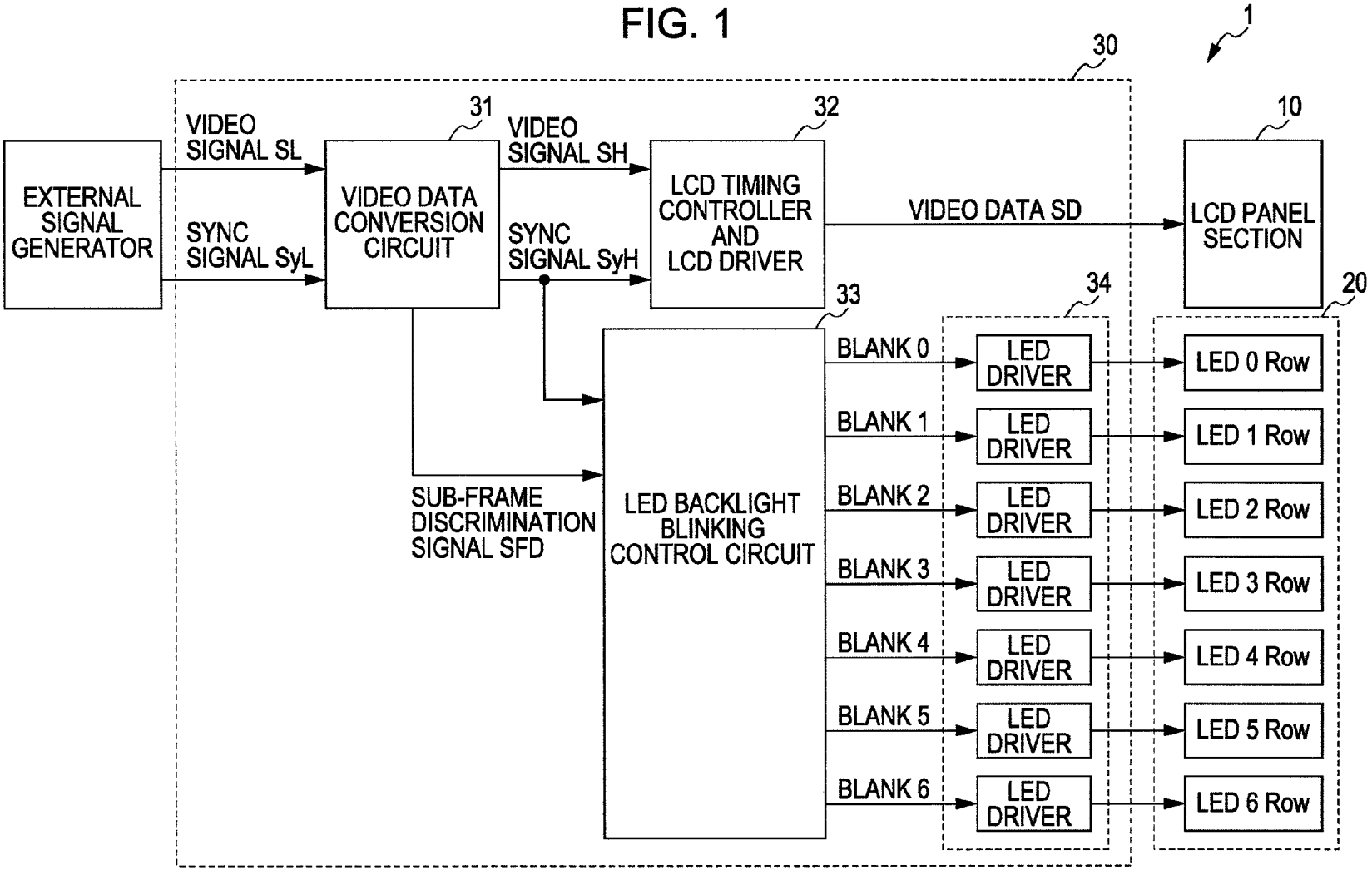
FIG. 1 is a block diagram of a liquid crystal display apparatus according to an embodiment of the present invention.

FIG. 1 is a block diagram illustrating a liquid crystal display apparatus according to an embodiment of the present invention. The liquid crystal display apparatus, indicated at 1, includes a liquid crystal display (LCD) panel section 10, a backlight section 20, and a circuit section 30. The LCD panel section 10, which is a section displaying an image, includes a liquid crystal display (LCD) panel for displaying an image. The backlight section 20 is located on a surface of the LCD panel away from an image display surface (image visible surface). That is, the backlight section 20 is disposed on the rear of the LCD panel away from the image display surface. The backlight section 20 includes an array of light emitting diodes (LEDs). In this embodiment, the array of the LEDs is divided into seven blocks. The seven blocks are arranged such that each block extends from end to end of the LCD panel in the horizontal scanning direction and has a width in the vertical direction. Each block, located on the rear of the LCD panel, irradiates the corresponding portion in the LCD panel so that an image can be visually recognized on a block-by-block basis.

The circuit section 30 includes a video data conversion circuit 31, an LCD timing controller and LCD driver (hereinafter, LCD timing controller/LCD driver) 32, an LED backlight blinking control circuit 33, and an LED driver section 34 including a plurality of LED drivers. The video data conversion circuit 31 is supplied with a video signal SL and a synchronization (hereinafter, "sync") signal SyL from an external signal generator. The video data conversion circuit 31 outputs a video signal SH and a sync signal SyH.

The video signal SL and the sync signal SyL are signals to be subjected to frequency multiplication and are similar to, for example, signals described in ITU_R BT. 709. The sync signal SyL includes two kinds of sync signals, i.e., a horizontal sync signal and a vertical sync signal. For example, the frequency of the vertical sync signal in the sync signal SyL is 60 Hz (hertz) and that of the horizontal sync signal therein is 67.5 kHz (kilohertz). To increase image resolution, the video data conversion circuit 31 multiplies the frequency, 60 Hz, of the vertical sync signal by two (i.e., doubles the frequency thereof) to obtain a vertical sync signal Vsync (refer to FIG. 6) having a frequency of 120 Hz. In addition, the video data conversion circuit 31 doubles the frequency of the horizontal sync signal to obtain a horizontal sync signal Hsync (see FIG. 6) having a frequency of 135 kHz. The sync signal SyH includes the vertical sync signal Vsync and the horizontal sync signal Hsync. Furthermore, the video data conversion circuit 31 outputs a sub-frame discrimination signal SFD. The sub-frame discrimination signal SFD is a signal for discriminating between a first sub-frame and a second sub-frame of a frame generated in accordance with each doubled vertical sync signal Vsync (see FIG. 6).

The sync signal SyH and the video signal SH are supplied to the LCD timing controller/LCD driver 32. The LCD timing controller/LCD driver 32 outputs video data SD, which is supplied to the LCD panel section 10. The sync signal SyH and the sub-frame discrimination signal SFD are supplied to the LED backlight blinking control circuit 33.

The LED backlight blinking control circuit 33 outputs blank signals BLANK 0 (or BLANK-0) to BLANK 6 (or BLANK-6) to the LED driver section 34. The LED driver section 34 drives the LEDs belonging to the seven blocks, indicated by "LED 0 Row (hereinafter, LED-0-Row)" to "LED 6 Row (hereinafter, LED-0-Row)", in the backlight section 20.

Figure 2:
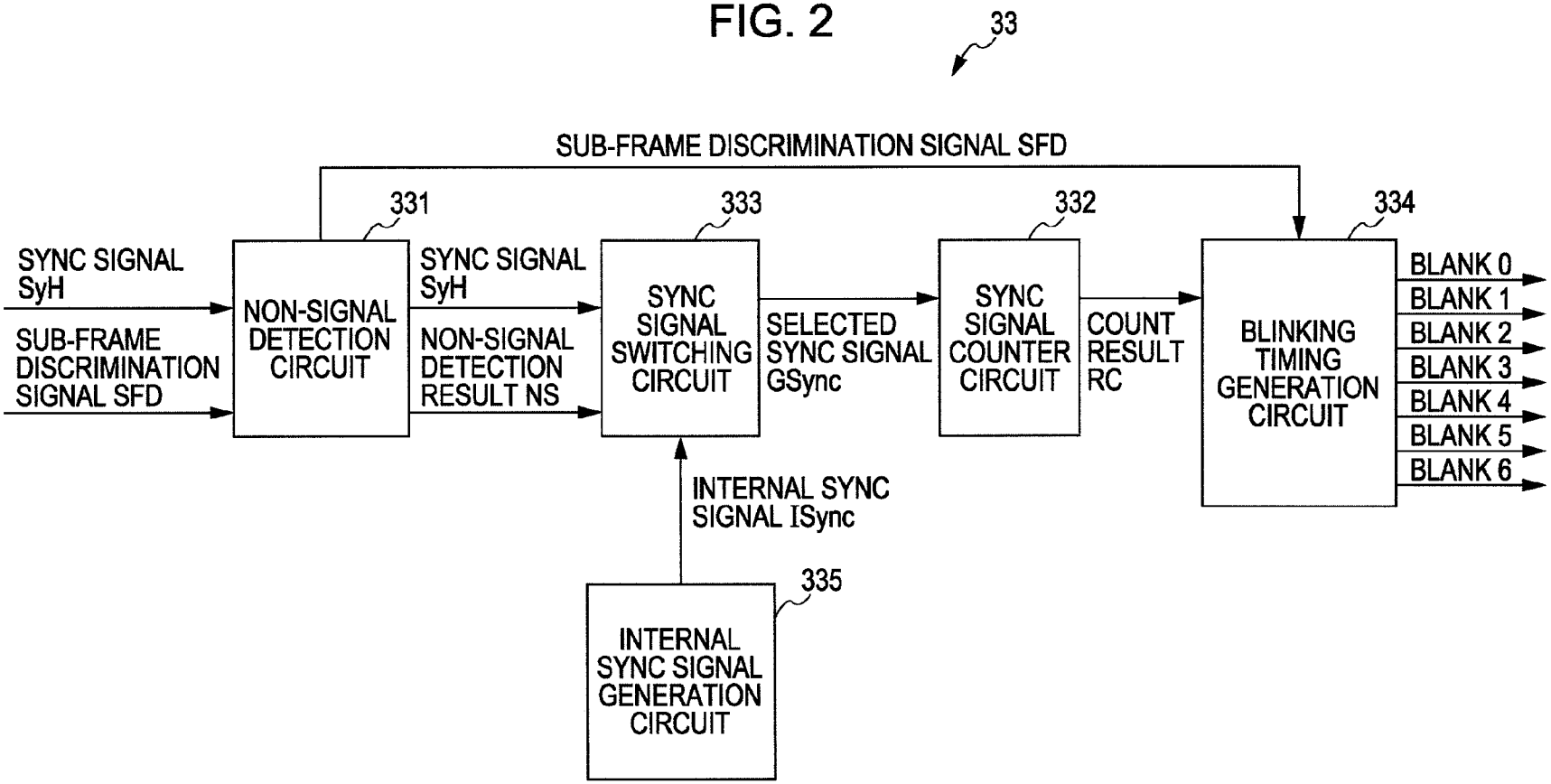
FIG. 2 is a block diagram of an LED backlight blinking control circuit.

FIG. 2 is a block diagram illustrating the LED backlight blinking control circuit 33. The LED backlight blinking control circuit 33 includes a non-signal detection circuit 331, a sync signal counter circuit 332, a sync signal switching circuit 333, a blinking timing generation circuit 334, and an internal sync signal generation circuit 335.

The non-signal detection circuit 331 detects a non-signal mode in which the sync signal SyH is not supplied. When detecting the non-signal mode, the non-signal detection circuit 331 outputs a signal indicating the result of non-signal detection (hereinafter, "non-signal detection result") NS to the sync signal switching circuit 333. Whereas, when detecting a signal mode in which the sync signal SyH is supplied, the non-signal detection circuit 331 outputs the sync signal SyH to the sync signal switching circuit 333 and also outputs the sub-frame discrimination signal SFD to the blinking timing generation circuit 334.

The sync signal counter circuit 332 outputs a signal indicating the result of count (hereinafter, "count result") RC to the blinking timing generation circuit 334. The count result RC indicates timings when to generate the respective blank signals, the timings being obtained by counting the number of horizontal sync signals Hsync of a selected sync signal GSync from a vertical sync signal Vsync as a starting point.

The sync signal switching circuit 333 outputs the selected sync signal GSync in accordance with the non-signal detection result NS. Since any sync signal is not supplied in the non-signal mode, blinking is stopped, so that black brightness varies in a full black screen in the non-signal mode. To prevent the variation, when the signal indicating the non-signal detection result NS is output (the non-signal mode), an internal sync signal ISync supplied from the internal sync signal generation circuit 335 is used as the selected sync signal GSync. A typical example of the non-signal detection result NS (the non-signal mode) is a case where a menu screen for setting a display state of the liquid crystal display apparatus 1 is displayed.

The blinking timing generation circuit 334 generates the blank signals BLANK-0 to BLANK-6 from the count result RC and the sub-frame discrimination signal SFD. The blank signals BLANK-0 to BLANK-6 will be described later.

Figure 3:
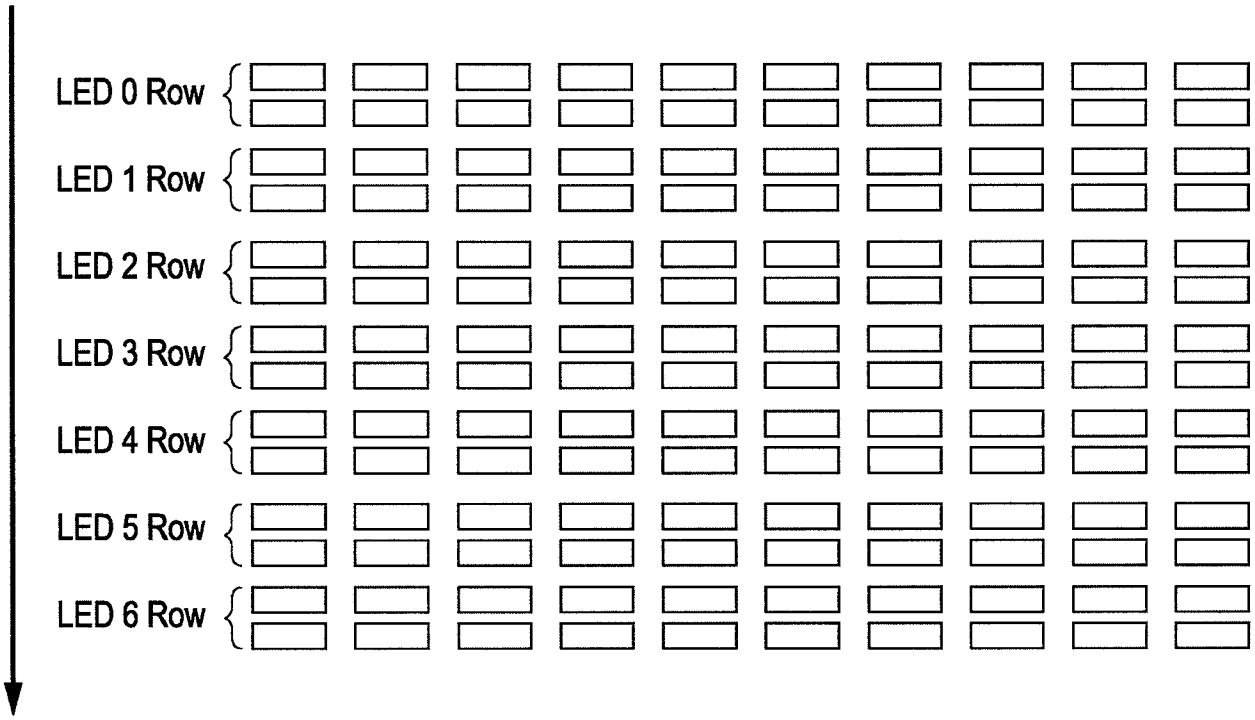
FIG. 3 is a diagram illustrating the array of LEDs in a backlight section.

FIG. 3 illustrates the array of the LEDs in the backlight section 20. In FIG. 3, each rectangle schematically illustrates one unit of LEDs controlled simultaneously. The block LED-0-Row includes two LED sequences each including ten units (LEDs) arranged in the horizontal direction (horizontal scanning direction). The block LED-1-Row similarly includes two LED sequences each including ten LEDs arranged in the horizontal direction. In addition, the blocks LED-2-Row, LED-3-Row, LED-4-Row, LED-5-Row, and LED-6-Row each including the same arrangement are disposed. The blocks LED-0-Row to LED-6-Row constitute the backlight section 20. All of the LEDs belonging to each block are simultaneously driven. Specifically, the LEDs belonging to the same block are controlled so that the LEDs are simultaneously turned on or off. The arrow shown in FIG. 3 indicates the vertical direction (vertical scanning direction).

Figure 4A:
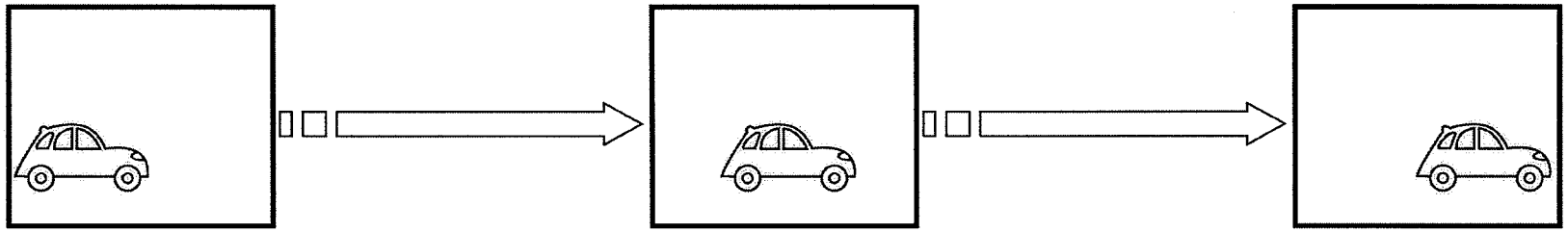
FIGS. 4A and 4B schematically illustrate images in the use of a related-art backlight blinking method in combination with sync frequency doubling.
Figure 4B:
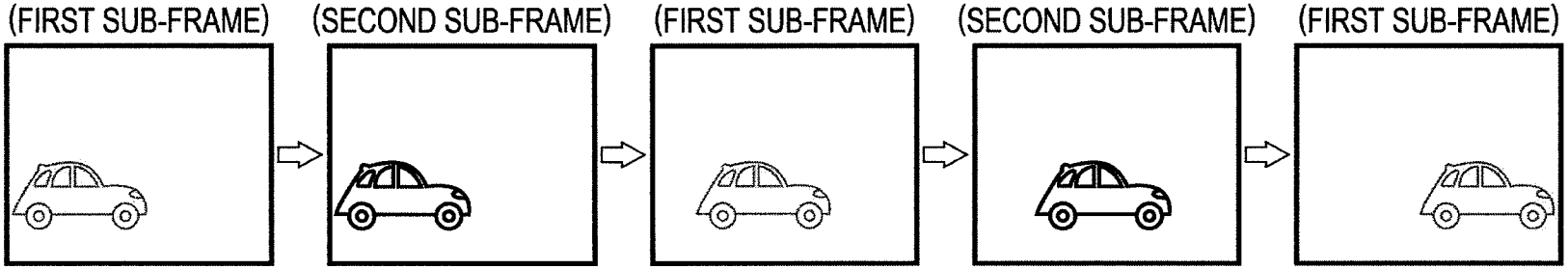
Figure 5A:
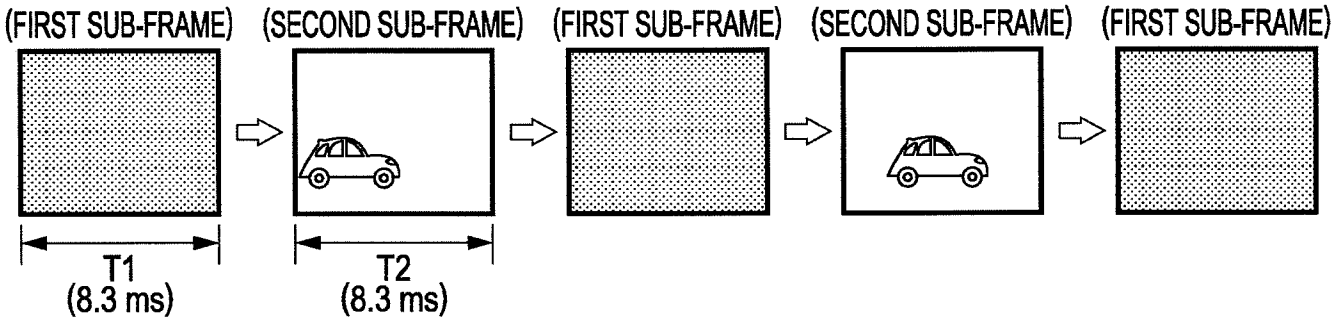
FIGS. 5A to 5C schematically illustrate images in the use of a backlight blinking method according to an embodiment of the present invention in combination with sync frequency multiplication.
Figure 5B:
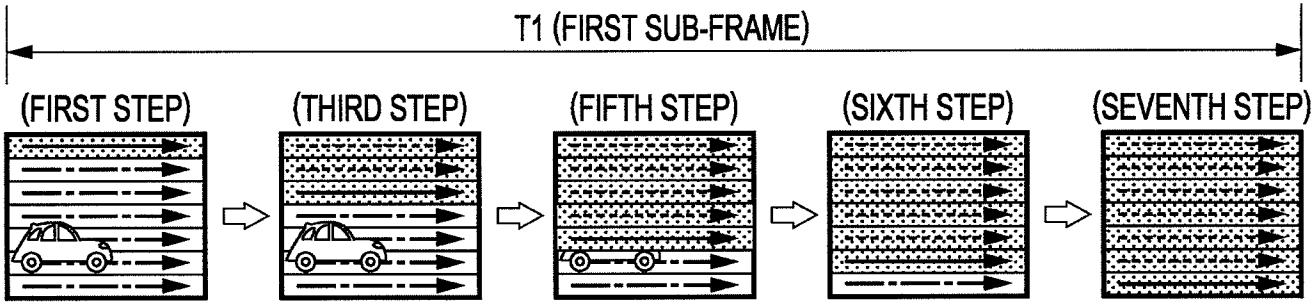
Figure 5C:
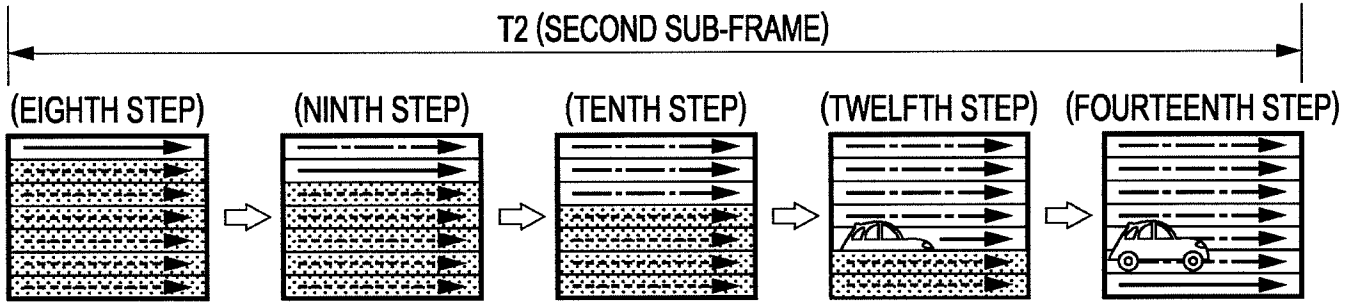

A control method used in the liquid crystal display apparatus 1 will now be described with reference to FIGS. 4A to 5C. FIGS. 4A and 4B schematically illustrate images obtained in the use of the related-art backlight blinking method, as a comparative example, in combination with the sync frequency doubling. FIGS. 5A to 5C schematically illustrate images obtained in the use of a backlight blinking method in the present embodiment in combination with the sync frequency doubling.

Comparative Example of Control Method

A comparative example will be first described with reference to FIGS. 4A and 4B. In FIGS. 4A and 4B, the horizontal direction, shown by arrows, indicates time elapsed. For example, the vertical sync frequency of an NTSC signal is 60 Hz. Accordingly, images are displayed as shown in FIG. 4A. In other words, one frame image is displayed every 60 Hz. FIG. 4B illustrates images displayed when the sync frequency is doubled so that the vertical sync frequency (60 Hz) is doubled to 120 Hz. Referring to FIG. 4B, two sub-frames are displayed every 60 Hz and these sub-frames have the same display contents. The former one of the two sub-frames having the same contents will be called a first sub-frame and the latter one will be called a second sub-frame in the following description.

In the LCD panel section 10, image display contents are displayed on a horizontal-line-by-horizontal-line basis. The same contents are held in each horizontal line until data for the horizontal line is rewritten. Generally, the response time of the LCD panel included in the LCD panel section 10 is not so fast. Accordingly, transient response upon image changing becomes a problem. This problem is common to driving at 60 Hz and driving at 120 Hz.

To solve this problem, the backlight section 20 which responds faster than the LCD panel is controlled. More specifically, each time data for one horizontal line is rewritten to change an image segment, the backlight is turned off until the response of the LCD panel follows up the change, thus improving the transient response. In doubling the vertical sync frequency to 120 Hz, however, it is difficult to reduce ghost effects using the related-art technique. In other words, an image under a transition state up to a steady state (during transient response) is displayed in each first sub-frame. The sharpness of the image is therefore low. In some cases, the transient state persists for a period corresponding to substantially one frame depending on a liquid crystal display grayscale level. On the other hand, since the same image as that in each first sub-frame is overwritten in the corresponding second sub-frame, any image during transient response is not displayed. In other words, the sharpness of image in each second sub-frame is fine. According to the related-art technique of turning off the backlight section 20 synchronously with horizontal line scanning, the images in each first sub-frame and the corresponding second sub-frame are merged into an image due to the persistence of vision and the resultant image is visually recognized. Thus, the sharpness of the image is reduced.

Embodiment of Control Method

A control method according to an embodiment of the present invention will be described with reference to FIGS. 5A to 5C. FIG. 5A is a diagram schematically explaining the principle of the control method according to the embodiment. Referring to FIG. 5A, any image is not displayed for a period T1 during which a first sub-frame is displayed and an image is displayed for a period T2 during which a second sib-frame is displayed. It is clear that the sharpness of the image is not reduced in such a display manner. As for an image displayed on a liquid crystal display panel, the contents of the image are not updated at a time on the entire image display surface of the liquid crystal display panel. Since the image display contents are rewritten on a horizontal-line-by-horizontal-line basis, the display manner is not achieved as it is in the liquid crystal display apparatus 1.

FIGS. 5B and 5C are diagrams explaining the control method, used in the liquid crystal display apparatus 1, according to the embodiment in which the image display contents are rewritten on a horizontal-line-by-horizontal-line basis. FIG. 5B schematically illustrates display of images for the period T1 during which a first sub-frame is displayed. FIG. 5C schematically illustrates display of images for the period T2 during which a second sub-frame is displayed. The liquid crystal display apparatus 1 achieves display based on the principle shown in FIG. 5A in the following manner.

In FIGS. 5B and 5C, each solid arrow indicates a block in the backlight section 20, the block irradiating a horizontal line which is being scanned. Each dash line indicates a block corresponding to a portion where horizontal line scanning has already been finished in a first sub-frame. Each alternate long and short dash line indicates a block corresponding to a portion where horizontal line scanning has already been finished in a second sub-frame. Each hatched block indicates a state in which the LEDs are turned off. Each open block indicates a state in which the LEDs are turned on. The horizontal lines are scanned on a line-by-line basis synchronously with a horizontal sync signal. In FIGS. 5B and 5C, the horizontal lines irradiated by a single block are shown by one arrow.

The first sub-frame shown in FIG. 5B will be described. Since time progresses from left to right in FIG. 5B, screens will be described in ascending order from the leftmost screen. The leftmost screen indicates a first step in which the uppermost block LED-0-Row is turned off and the other blocks LED-1-Row to LED-6-Row are turned on. The time when the turn-off of the block LED-0-Row starts is the time when scanning of the uppermost one of horizontal lines, for which the block LED-0-Row functions as a backlight, is started. In the first step, a portion for which the block LED-0-Row functions as the backlight (i.e., irradiated horizontal lines when the block LED-0-Row is turned on) is subjected to horizontal scanning. Specifically, an image segment is written on each horizontal line in this portion of the LCD panel in the LCD panel section 10. In other words, the image segment based on the video data SD for each horizontal line is displayed on the LCD panel. However, since the block LED-0-Row is turned off, the written image segment is not visually recognized.

In a second step (not shown), the blocks LED-0-Row and LED-1-Row are turned off and the other blocks LED-2-Row to LED-6-Row are turned on. The time when the turn-off of the block LED-1-Row starts is the time when scanning of horizontal lines for which the block LED-1-Row functions as a backlight is started. In the second step, the portion in which the block LED-1-Row functions as the backlight is subjected to horizontal scanning. Specifically, an image segment is written on each horizontal line in this portion of the LCD panel in the LCD panel section 10. However, since the block LED-1-Row is turned off, the written image segment is not visually recognized.

The second screen from the left indicates a third step. In the third step, the blocks LED-0-Row to LED-2-Row are turned off and the other blocks LED-3-Row to LED-6-Row are turned on. The time when the turn-off of the block LED-2-Row starts is the time when scanning of horizontal lines for which the block LED-2-Row functions as a backlight is started. In the third step, a portion for which the block LED-2-Row functions as the backlight is subjected to horizontal scanning. Specifically, an image segment is written on each horizontal line in this portion of the LCD panel in the LCD panel section 10. However, since the block LED-2-Row is turned off, the written image segment is not visually recognized.

In a forth step (not shown), the blocks LED-0-Row to LED-3-Row are turned off and the other blocks LED-4-Row to LED-6-Row are turned on. The time when the turn-off of the block LED-3-Row starts is the time when scanning of horizontal lines for which the block LED-3-Row functions as a backlight is started. In the fourth step, a portion for which the block LED-3-Row functions as the backlight is subjected to horizontal scanning. Specifically, an image segment is written on each horizontal line in this portion of the LCD panel in the LCD panel section 10. However, since the block LED-3-Row is turned off, the written image segment is not visually recognized.

The third screen from the left indicates a fifth step. In the fifth step, the blocks LED-0-Row to LED-4-Row are turned off and the other blocks LED-5-Row and LED-6-Row are turned on. The time when the turn-off of the block LED-4-Row starts is the time when scanning of horizontal lines for which the block LED-4-Row functions as a backlight is started. In the fifth step, a portion for which the block LED-4-Row functions as the backlight is subjected to horizontal scanning. Specifically, an image segment is written on each horizontal line in this portion of the LCD panel in the LCD panel section 10. However, since the block LED-4-Row is turned off, the written image segment is not visually recognized.

The fourth screen from the left indicates a sixth step. In the sixth step, the blocks LED-0-Row to LED-5-Row are turned off and the other block LED-6-Row is turned on. The time when the turn-off of the block LED-5-Row starts is the time when scanning of horizontal lines for which the block LED-5-Row functions as a backlight is started. In the sixth step, a portion for which the block LED-5-Row functions as the backlight is subjected to horizontal scanning. Specifically, an image segment is written on each horizontal line in this portion of the LCD panel in the LCD panel section 10. However, since the block LED-5-Row is turned off, the written image segment is not visually recognized.

The fifth screen from the left (i.e., the rightmost screen) indicates a seventh step. In the seventh step, all of the LEDs in the blocks LED-0-Row to LED-6-Row are turned off. The time when the turn-off of the block LED-6-Row starts is the time when scanning of horizontal lines for which the block LED-6-Row functions as a backlight is started. In the seventh step, a portion for which the block LED-6-Row functions as the backlight is subjected to horizontal scanning. Specifically, an image segment is written on each horizontal line in this portion of the LCD panel in the LCD panel section 10. However, since the block LED-6-Row is turned off, the written image segment is not visually recognized.

During the period T1, the first sub-frame having the above-described first to seventh steps is finished. Specifically, while the LEDs belonging to the respective blocks are sequentially turned off on a block-by-block basis, an image is sequentially written such that an image segment is written on a horizontal-line-by-horizontal-line basis in a portion irradiated by each block. The image displayed in the first sub-frame in FIG. 5B is that displayed in the second sub-frame of the preceding cycle.

A second sub-frame will be described. Since time progresses from left to right in FIG. 5C, screens will be described in ascending order from the leftmost one. The leftmost screen represents an eighth step in which the uppermost block LED-0-Row is turned on and the other blocks LED-1-Row to LED-6-Row are turned off. The time when the turn-off of the block LED-0-Row starts is the time when scanning of the uppermost one of the horizontal lines for which the block LED-0-Row functions as the backlight is started. In the eighth step, the portion for which the block LED-0-Row functions as the backlight is subjected to horizontal scanning. Specifically, the image segment is written on each horizontal line in this portion of the LCD panel in the LCD panel section 10. Since the block LED-0-Row is turned on, the written image segment is visually recognized.

The second screen from the left represents a ninth step. In the ninth step, the blocks LED-0-Row and LED-1-Row are turned on and the other blocks LED-2-Row to LED-6-Row are turned off. The time when the turn-on of the block LED-1-Row starts is the time when scanning of the horizontal lines for which the block LED-1-Row functions as the backlight is started. In the ninth step, the portion for which the block LED-1-Row functions as the backlight is subjected to horizontal scanning. Specifically, the image segment is written on each horizontal line in this portion of the LCD panel in the LCD panel section 10. Since the block LED-1-Row is turned on, the written image segment is visually recognized.

The third screen from the left represents a tenth step. In the tenth step, the blocks LED-0-Row to LED-2-Row are turned on and the other blocks LED-3-Row to LED-6-Row are turned off. The time when the turn-on of the block LED-2-Row starts is the time when scanning of the horizontal lines for which the block LED-2-Row functions as the backlight is started. In the tenth step, the portion for which the block LED-2-Row functions as the backlight is subjected to horizontal scanning. Specifically, the image segment is written on each horizontal line in this portion of the LCD panel in the LCD panel section 10. Since the block LED-2-Row is turned on, the written image segment is visually recognized.

In an eleventh step (not shown), the blocks LED-0-Row to LED-3-Row are turned on and the other blocks LED-4-Row to LED-6-Row are turned off. The time when the turn-on of the block LED-3-Row starts is the time when scanning of the horizontal lines for which the block LED-3-Row functions as the backlight is started. In the eleventh step, the portion for which the block LED-3-Row functions as the backlight is subjected to horizontal scanning. Specifically, the image segment is written on each horizontal line in this portion of the LCD panel in the LCD panel section 10. Since the block LED-3-Row is turned on, the written image segment is visually recognized.

The fourth screen from the left represents a twelfth step. In the twelfth step, the blocks LED-0-Row to LED-4-Row are turned on and the other blocks LED-5-Row and LED-6-Row are turned off. The time when the turn-on of the block LED-4-Row starts is the time when scanning of the horizontal lines for which the block LED-4-Row functions as the backlight is started. In the twelfth step, the portion for which the block LED-4-Row functions as the backlight is subjected to horizontal scanning. Specifically, the image segment is written on each horizontal line in this portion of the LCD panel in the LCD panel section 10. Since the block LED-4-Row is turned on, the written image segment is visually recognized.

In a thirteenth step (not illustrated), the blocks LED-0-Row to LED-5-Row are turned on and the other block LED-6-Row is turned off. The time when the turn-on of the block LED-5-Row starts is the time when scanning of the horizontal lines for which the block LED-5-Row functions as the backlight is started. In the thirteenth step, the portion for which the block LED-5-Row functions as the backlight is subjected to horizontal scanning. Specifically, the image segment is written on each horizontal line in this portion of the LCD panel in the LCD panel section 10. Since the block LED-5-Row is turned on, the written image segment is visually recognized.

The fifth screen from the left (i.e., the rightmost screen) represents a fourteenth step. In the fourteenth step, all of the LEDs in the blocks LED-0-Row to LED-6-Row are turned on. The time when the turn-on of the block LED-6-Row starts is the time when scanning of the horizontal lines for which the block LED-6-Row functions as the backlight is started. In the fourteenth step, the portion for which the block LED-6-Row functions as the backlight is subjected to horizontal scanning. Specifically, the image segment is written on each horizontal line in this portion of the LCD panel in the LCD panel section 10. Since the block LED-6-Row is turned on, the written image segment is visually recognized.

During the period T2, the second sub-frame having the above-described eighth to fourteenth steps is finished. In other words, while the LEDs belonging to the respective blocks are sequentially turned on a block-by-block basis, an image is sequentially written such that an image segment is written on a horizontal-line-by-horizontal-line basis in a portion irradiated by each block. Sequentially turning off the LEDs of the respective blocks for the period T1 and sequentially turning on the LEDs of the respective blocks for the period T2 as described above prevent the difference in viewing quality depending on response time between upper and lower parts of a screen. In other words, in the use of the sequential turn-off and turn-on, the uniform response characteristic can be obtained in the entire screen, thus increasing picture quality.

Figure 6:
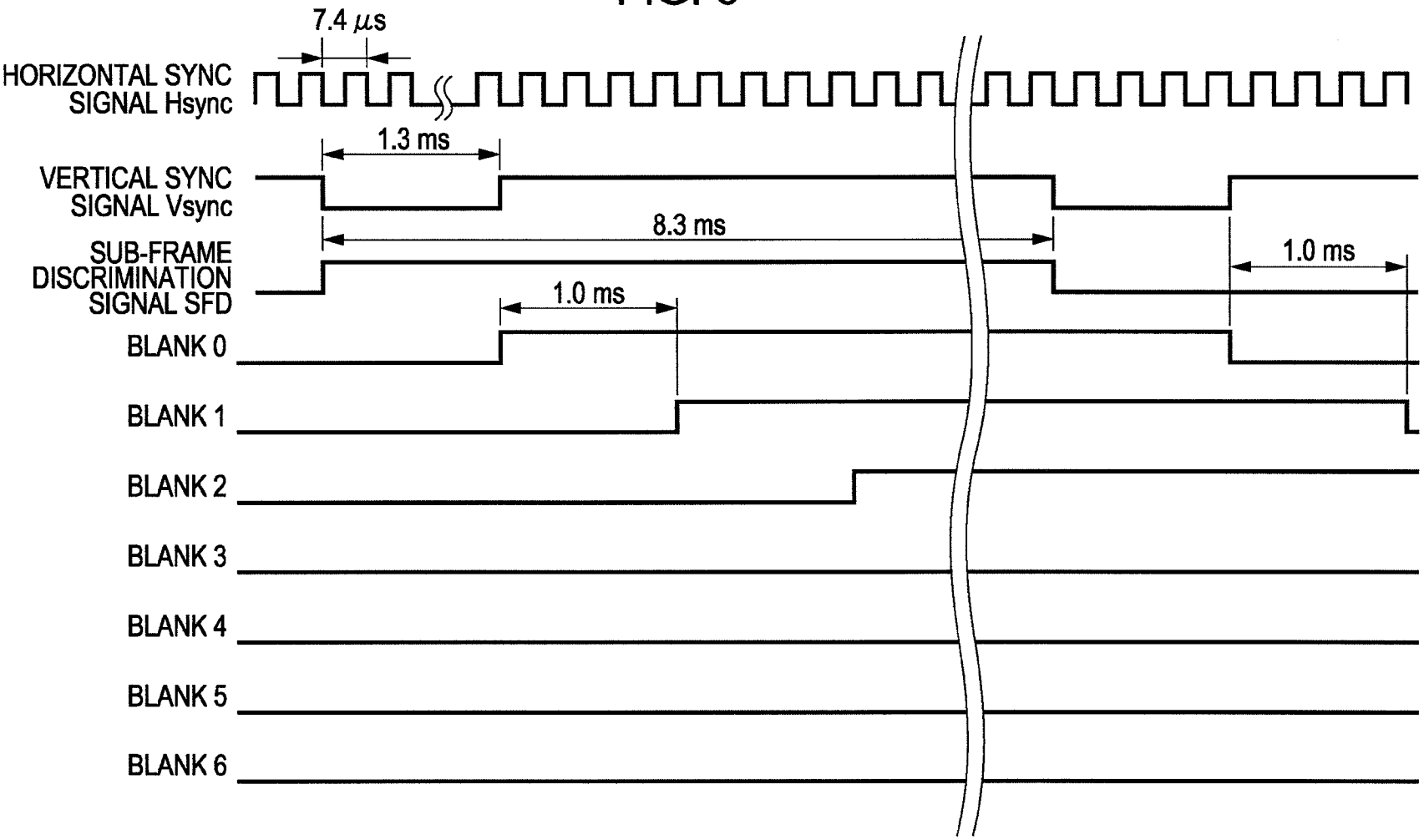
FIG. 6 is a timing chart of signals generated by a circuit section of the liquid crystal display apparatus according to the embodiment.

FIG. 6 is a diagram illustrating a timing chart of signals generated by the circuit section 30 for achieving the control method according to the above-described embodiment, the method being used in the liquid crystal display apparatus according to the foregoing embodiment. Referring to FIG. 6, a horizontal sync signal Hsync and a vertical sync signal Vsync are included in a selected sync signal GSync. The blinking timing generation circuit 334 generates blank signals BLANK-0 to BLANK-6 on the basis of the vertical sync signal Vsync and a sub-frame discrimination signal SFD.

The horizontal sync signal Hsync, the vertical sync signal Vsync, and the sub-frame discrimination signal SFD are sequentially shown from the top toward the bottom in FIG. 6. In addition, the blank signals BLANK-0 to BLANK-6 are shown. The sub-frame discrimination signal SFD at a high level corresponds to a first sub-frame and that at a low level corresponds to a second sub-frame. As for the blank signals BLANK-0 to BLANK-6, the signal at a low level indicates turn-on and that at a high level indicates turn-off. Although the vertical sync signal Vsync has a frequency of 120 Hz in the embodiments, the frequency is not limited to the value. Any frequency, for example, a frequency of 100 Hz obtained by doubling 50 Hz may be used. In addition, the horizontal sync signal Hsync may have a frequency suitable for any of various frequencies for the vertical sync signal Vsync.

Advantages of the embodiments will be described below. According to the related-art frequency multiplying technique, for example, related-art frequency doubling technique, an image is written as a first sub-frame and a second-sub-frame, namely, twice in an LCD panel in order to accommodate the image, generally synchronized with a vertical sync signal of 60 Hz, to a vertical sync signal of 120 Hz. In each of the two writing, the LCD panel is irradiated by a backlight. In this case, since video information changes in the first writing, the follow-up of liquid crystal is delayed, thus causing moving picture blur. According to the technique in accordance with the embodiments, since the circuit section 30 controls the LCD panel section 10 synchronously with the backlight section 20, no moving picture blur occurs.

Specifically, according to the technique in the embodiments, the circuit section 30 controls the LCD panel section 10 and the backlight section 20 on an image for a first sub-frame, serving as a first write sub-frame in which moving picture blur occurs, in the following manner. An LED block corresponding to a portion where an image segment is being written (the contents of an image are being updated) in the LCD panel section 10 is turned off in accordance with the LED backlight blinking method. On the other hand, the circuit section 30 controls the LCD panel section 10 and the backlight section 20 on an image for the next write sub-frame (second sub-frame), in which no moving picture blur occurs, in the following manner, the next write sub-frame serving as a write sub-frame having the same contents as that of the first sub-frame. An LED block corresponding to a portion where an image segment is being written in the LCD panel section 10 is turned on in accordance with the LED backlight blinking method. Consequently, the image of the first sub-frame is not visually recognized, thus improving moving picture response time. Accordingly, ghost effects, which have been a problem, do not occur. Furthermore, the LED blocks are sequentially turned off in each first sub-frame and are sequentially turned on in each second sub-frame, so that the uniform response characteristic can be obtained in the entire single screen.

Various modifications of the above-described embodiments can be made. For example, the number of blocks arranged in the vertical scanning direction in the backlight section disposed on the rear of the LCD panel is not limited to seven. The frequency multiplication is not limited to doubling the frequency of an original vertical sync signal. The frequency of an original vertical sync signal can be multiplied by three or more, e.g., four. In other words, a modification can be similarly performed by the following control even when the frequency of an original vertical sync signal is multiplied by three or more. The circuit section controls the LED blocks in the first one of sub-frames, whose number is equal to a multiple number, having the same contents so as to turn off an LED block irradiating a portion, where the contents of an image is being updated, in the LCD panel. On the other hand, in a sub-frame other than the first sub-frame of the sub-frames having the same contents, the circuit section controls the LED blocks so as to turn on an LED block irradiating a portion, where the contents of the image is being updated, in the LCD panel. The components of the backlight section are not limited to LEDs. When the backlight section includes a vacuum fluorescent display, a modification can be achieved.

The present application contains subject matter related to that disclosed in Japanese Priority Patent Application JP 2008-129458 filed in the Japan Patent Office on May 16, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display apparatus comprising:

a liquid crystal display panel section including a liquid crystal display panel;

a backlight section placed on the rear of the liquid crystal display panel away from an image display surface, the backlight section extending from end to end of the liquid crystal display panel in a horizontal scanning direction and including a plurality of blocks arranged in a vertical scanning direction; and a circuit section that performs control in a first sub-frame and a second sub-frame, wherein each of the first sub-frame and the second sub-frame includes identical image contents to be displayed on the liquid crystal display panel, wherein performing control in the first sub-frame comprises sequentially turning off blocks of the backlight section irradiating portions of the liquid crystal display panel as image segments are being updated for the portions of the liquid crystal display panel during the display of the first sub-frame, and wherein performing control in the second sub-frame-comprises sequentially turning on blocks of the backlight section irradiating portions of the liquid crystal display panel as image segments are being updated for the portions of the liquid crystal display panel during display of the second sub-frame.

2. The liquid crystal display apparatus according to claim 1, wherein the circuit section includes a video data conversion circuit, a liquid crystal display timing controller, a liquid crystal display driver, wherein the video data conversion circuit, the liquid crystal display timing controller, and the liquid crystal display driver operate to provide video data for the first and second sub-frames from a video signal, corresponding to one frame, generated every vertical synchronization period; and a backlight blinking control circuit that generates signals for controlling the respective blocks in the backlight section on the basis of a synchronization signal and a sub-frame discrimination signal output from the video data conversion circuit.

3. The liquid crystal display apparatus according to claim 1, wherein the backlight section includes an LED.

4. A method for controlling a liquid crystal display apparatus including a liquid crystal display panel, a backlight section, and a circuit section, the backlight section being placed on the rear of the liquid crystal display panel away from an image display surface, the backlight section extending from end to end of the liquid crystal display panel in the horizontal scanning direction, the backlight section including a plurality of blocks arranged in the vertical scanning direction, the method comprising acts of:

performing control in a first sub-frame of a plurality of sub-frames having identical image contents to be displayed on the liquid crystal display panel, wherein performing control in the first sub-frame comprises sequentially turning off blocks of the backlight section irradiating portions of the liquid crystal display panel as image segments are being updated for the portions of the liquid crystal display panel during the display of the first sub-frame; and performing control in a second sub-frame of the plurality of sub-frames, wherein performing control in the second sub-frame comprises sequentially turning on blocks of the backlight section irradiating portions of the liquid crystal display panel as image segments are being updated for the portions of the liquid crystal display panel during display of the second sub-frame.

* * * * *